US007044593B2

(12) United States Patent
Onishi

(10) Patent No.: US 7,044,593 B2
(45) Date of Patent: May 16, 2006

(54) CONTAINER FOR HOLDING TREATING AGENT FOR FORMING INK-RECEIVING LAYER CONTAINER FOR HOLDING INK RECORDING DEVICE AND RECORDING METHOD

(75) Inventor: Hiroyuki Onishi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/451,140

(22) PCT Filed: Jan. 17, 2002

(86) PCT No.: PCT/JP02/00285

§ 371 (c)(1),
(2), (4) Date: Oct. 10, 2003

(87) PCT Pub. No.: WO02/057083

PCT Pub. Date: Jul. 25, 2002

(65) Prior Publication Data

US 2004/0046849 A1 Mar. 11, 2004

(30) Foreign Application Priority Data

Jan. 17, 2001 (JP) ..... 2001-009500

(51) Int. Cl.
*B41J 2/01* (2006.01)

(52) U.S. Cl. ..... 347/101; 347/102

(58) Field of Classification Search ..... 347/14, 347/16, 101–102, 105, 20, 56, 61, 19
See application file for complete search history.

(56) References Cited

U.S. PATENT DOCUMENTS 6,126,281 A * 10/2000 Shimoda et al. ..... 347/101
6,254,230 B1 * 7/2001 Wen et al. ..... 347/101
6,325,505 B1 * 12/2001 Walker ..... 347/105
6,326,505 B1 * 12/2001 Vaartstra ..... 556/1

FOREIGN PATENT DOCUMENTS

JP 2002-127389 5/2002

OTHER PUBLICATIONS

Patent Abstract of Japan and Japan Patent Office English Computer Translation of JP 2002-127389 Dated May 8, 2002.

* cited by examiner

*Primary Examiner*—Juanita D. Stephens

(74) *Attorney, Agent, or Firm*—Ladas & Parry LLP

(57) ABSTRACT

It is an object of the present invention to provide a container for holding a treatment agent used to form an ink receiving layer, and a container for holding ink, with which high-quality recording can be easily performed regardless of the type of recording medium, as well as a recording device and recording method that make use of these [containers]. The container of the present invention for holding a treatment agent used to form an ink receiving layer holds a treatment agent that is applied on the substrate surface of a recording medium to form an ink receiving layer prior to specific recording being performed by ink jet method.

6 Claims, 6 Drawing Sheets

CONTAINER FOR HOLDING TREATING AGENT FOR FORMING INK-RECEIVING LAYER CONTAINER FOR HOLDING INK RECORDING DEVICE AND RECORDING METHOD

TECHNICAL FIELD

This invention relates to a container for holding a treatment agent used to form an ink receiving layer, and to a container for holding ink, with which high-quality recording can be easily performed regardless of the type of recording medium, as well as a recording device and recording method that make use of these [containers].

BACKGROUND ART

The recording of various kinds of images by ink jet printing is an easy way to record high-quality images, and is therefore used by many different users, including personal users.

Since ink jet printing does not yield a very high-quality image on ordinary paper, the recording medium that is used has formed on it an ink receiving layer that absorbs and holds the colorant in ink.

When a high-quality image is to be recorded, special paper on which an ink receiving layer has been formed must be used as the recording medium, and an image cannot be recorded without first selecting the type of recording medium, so there is currently a need to be able to record high-quality images without having to select the recording medium.

It is therefore an object of the present invention to provide a container for holding ink, and a recording device equipped with said container, with which high-quality recording can be performed easily, without haying to select the type of recording medium.

DISCLOSURE OF THE INVENTION

The stated object is achieved by providing a container for holding a treatment agent used to form an ink receiving layer, which holds a treatment agent that is used to form an ink receiving layer by coating the substrate surface of a recording medium prior to specific recording being performed by ink jet method.

The present invention achieves the stated object by providing a container for holding ink, which is used to perform specific recording on the substrate of a recording medium by discharging ink by ink jet method, comprising a container for holding a treatment agent used to form an ink receiving layer, which holds a treatment agent that is used to form an ink receiving layer by coating the substrate surface of a recording medium prior to specific recording being performed by ink jet method, and further comprising an ink holding chamber, which holds at least one type of ink, and/or an overcoat liquid holding chamber, which holds an overcoat liquid.

It is preferable here if the container for holding a treatment agent used to form an ink receiving layer, and the treatment agent used to form an ink receiving layer used in the holding container, of the present invention are made from a composition composed of at least the active components ordinarily used in paints for forming ink receiving layers, namely, pigments, binders, and auxiliaries. The mixing ratio (weight ratio) between the combined amount of the various active components mentioned above and the solvent should be 1:5 to 1:100 (active components:solvent).

In order to obtain good ink absorbency and coloration density, the above-mentioned pigment should be porous and have a low refractive index, examples of which include alumina, amorphous silica, precipitated silica, gel type silica, vapor phase silica, barium sulfate, titanium dioxide, calcium carbonate, kaolin, white clay, magnesium silicate, and calcium silicate.

The above-mentioned binder can be a nonionic resin such as polyvinyl alcohol (PVA), or a polymer latex, gelatin, casein, or starch.

The above-mentioned auxiliary can be a primary to tertiary amine compound; a primary to tertiary amine salt; a quaternary ammonium salt; an oligomer having a primary to tertiary amino group, primary to tertiary amine base, or quaternary ammonium base, or a polymer having any of these groups, or another such cationic organic substance; a light stabilizer; a fluorescent whitener; or the like.

More specifically, examples of cationic polymers that can be used in the present invention include dicyandiamide/diethylenetriamine polymers, dicyandiamide/formalin polymers, methacrylate quaternary ammonium salt polymers, dimethylamine/ammonia/epichlorohydrin polymers, diallyldimethylammonium salt polymers, diallyldimethylammonium salt/acrylamide polymers, diallylamine/epichlorohydrin polymers, diallylamine salt/acrylamide polymers, and diallylamine salt/acrylic acid/acrylamide polymers.

A polyvalent metal salt, and more specifically a magnesium compound, aluminum compound, calcium compound, or the like, may also be added to the treatment agent used to form an ink receiving layer.

Since the treatment agent used to form an ink receiving layer is discharged from an ink jet head, it should have the same properties as the ink, such as its surface tension, viscosity, and pH.

Moreover, preservatives, bactericides, leveling agents, and other additives can also be added to the treatment agent used to form the ink receiving layer.

The treatment agent used to form an ink receiving layer used in the present invention can be prepared by dissolving or dispersing the above-mentioned active components in the above-mentioned solvent by a standard method, with no particular restrictions thereon.

Neither are there any particular restrictions on the substrate of the recording medium used in the present invention, as long as it is one that allows recording by an ordinary ink jet method. Specific examples include ordinary paper, copier paper, printer paper, cotton cloth, canvas, film, plastic, and metal.

The present invention achieves the stated object by providing a recording device comprising an ink holding chamber that holds at least one type of ink, and a container for holding a treatment agent used to form an ink receiving layer, which holds a treatment agent that is used to form an ink receiving layer by coating the substrate surface of a recording medium prior to specific recording being performed by ink jet method, and/or an overcoat liquid holding chamber, which holds an overcoat liquid.

The above-mentioned container for holding ink is preferably formed integrally with the above-mentioned container for holding a treatment agent and/or the container for holding an overcoat liquid.

The present invention provides a recording device, comprising a print head for discharging ink, and a print head for discharging a treatment agent used to form an ink receiving layer by coating the substrate of a recording medium prior to specific recording being performed by ink jet method, and/or a post-print head for discharging an overcoat liquid.

The pre-print head referred to here is a recording head that discharges a treatment agent used to form an ink receiving layer from a container for holding ink, which is provided with a treatment agent used to form an ink receiving layer. The post-print head is a recording head that discharges an overcoat liquid from a container for holding ink, which is provided with an overcoat liquid.

Overcoat liquids that can be used to advantage here include those having the function of improving gloss, giving a matte finish, improving water resistance, improving light fastness, improving gas resistance, improving wear resistance, preventing oxidation, absorbing UV rays, absorbing radicals, improving film formability, and so forth.

Any of the various commercially available products listed below, for example, may be contained as active components in an overcoat liquid having the function of improving light fastness. Specifically, examples include Adekastab LA-77, Adekastab LA-87, Adekastab LA-82, Adekastab LA-52, Adekastab LA-57, Adekastab LA-62, Adekastab LA-63, and Adekastab LA-68 (all trade names of Asahi Denka); Sanol LS770 and Sanol LS440 (both trade names of Sankyo); Tinuvin 292, Tinuvin 123, Tinuvin 144, Tinuvin 440, Tinuvin 622, and Chimassorb 944 (all trade names of Ciba Geigy); Goof-rite UV3034 (trade name of BF Goodrich); Cyasorb UV3346 (trade name of Cytec); and other such hindered amine compounds. These can be used singly or in mixtures of two or more types.

The standard antioxidants listed below, for example, may be contained as active components in an overcoat liquid having the function of preventing oxidation. Specifically, examples include 2,6-tert-butyl-p-cresol, 2,6-tert-butyl-4-ethylphenol, 4,4'-methylenebis(3-methyl-6-tert-butylphenol), 4,4'-thiobis(3-methyl-6-tert-butylphenol), 2,4-dimethyl-6-tert-butylphenol, 4-isooctylphenol, hydroquinone, 2,4-dioxybenzophenone, 2-oxy-4-methoxybenzophenone, diphenylolpropane, 2,2-bis-(3-methyl-4-oxyphenyl)propane, 1,1-bis-(4-oxyphenyl)cyclohexane, 2,2', 4,4'tetrahydroxysepachiphenone, dodecahydrotriphenylene, a three-molecule condensate of cyclohexanone, a six-molecule condensate of cyclohexanone, resorcinol dibenzoate, disalicyl resorcin, phenyl salicylate, β-naphthoxypropene oxide, various tocophenol compounds, various bisphenol compounds, and various phosphorous acid ester compounds. These can be used singly or in mixtures of two or more types.

An overcoat liquid having the function of absorbing UV rays may contain a salicylic acid-based UV absorbent, benzophenone-based UV absorbent, benzotriazole-based UV absorbent, cyanoacrylate-based UV absorbent, or the like as an active component, for example.

Favorable salicylic acid-based UV absorbents include phenyl salicylate and p-tert-butylphenyl salicylate. Favorable benzophenone-based UV absorbents include 2,4-hydroxybenzophenone, 2-hydroxy-4-methoxybenzophenone, 2-hydroxy-4-octoxybenzophenone, 2,2'-dihydroxy-4-methoxybenzophenone, 2-hydroxy-4-methoxy-5-sulfobenzophenone, and 2,2'-dihydroxy-4,4'-dimethoxy-5-sulfobenzophenone sodium salt. Favorable benzotriazole-based UV absorbents include 2-(2'-hydroxy-5'-methylphenyl)benzotriazole, 2-(2'-hydroxy-3',5'-di-tert-butylphenyl)benzotriazole, 2-(2'-hydroxy-3'-tert-butyl-5'-methylphenyl)-5-chlorobenzotriazole, and 2-(2'-hydroxy-3',5'-di-tert-amylphenyl) benzotriazole. Favorable cyanoacrylate-based UV absorbents include 2-ethylhexyl-2-cyano-3,3'-diphenyl acrylate, and ethyl-2-cyano-3,3'-diphenyl acrylate. In addition, 4-bis(polyethoxy)-p-aminobenzoic acid polyethoxyethyl ester, macromolecular 2-(2'-hydroxy-5'-methacryloxyphenyl)-2H-benzotriazole, emulsion-type macromolecular UV absorbents, and so forth are favorable as organic UV absorbents. Titanium oxide, zinc oxide, cerium oxide, and so forth are favorable as inorganic UV absorbents.

An overcoat liquid having the function of improving film formability may contain the resins listed below as active components, for example. As long as this resin allows the formation of a resin film that will exhibit resistance to water and wear, a thermoplastic resin can be used favorably. Examples of thermoplastic resins include polyacrylic acids, polymethacrylic acid esters, polyethylacrylic acids, styrene-butadiene copolymers, polybutadiene, acrylonitrile-butadiene copolymers, chloroprene copolymers, fluororesins, vinylidene fluoride, polyolefin resins, cellulose, styrene-acrylic acid copolymers, styrene-methacrylic acid copolymers, polystyrene, styrene-acrylamide copolymers, polyisobutyl acrylate, polyacrylonitrile, polyvinyl acetate, polyvinyl acetal, polyamide, rosin-based resins, polyethylene, polycarbonate, vinylidene chloride resins, cellulose-based resins, vinyl acetate resins, ethylene-vinyl acetate copolymers, vinyl acetate-acrylic copolymers, vinyl chloride resins, polyurethane, rosin esters, polyethylene wax, montan wax, alcohol wax, synthetic oxide wax, α-olefin-maleic anhydride copolymers, carnauba wax, lanolin, paraffin wax, and microcrystalline wax. These can be used singly or in mixtures of two or more types.

An overcoat liquid having the function of improving radical absorption may contain the radical absorption improvers listed below, for example. As long as generated radicals can be quenched, a hindered amine compound can be used favorably, for example. Examples of hindered amine compounds include 4-benzoyloxy-2,2,6,6-tetramethylpiperidine, bis-2,2,6,6-tetramethyl-4-piperidyl) malonate, bis-2,2,6,6-tetramethyl-4-piperidyl) phthalate, 2,2,6,6-tetramethyl-4-piperidyl benzoate, 4-amino-2,2,6,6-tetramethylpiperidine, 2,2,6,6-tetramethyl-4-piperidylsebacate, bis-(2,2,6,6-tetramethyl- 4-methylpiperidyl) sebacate, di-(1,2,2,6,6-pentamethyl-4-piperidyl)-2-n-butyl-2-(3,5-tert-butyl-4-hydroxybenzyl) malonate, bis-(2,2,6,6-tetramethyl-4-carbonyloxypiperidino)-p-dimethylbenzyl, 2,2,4,4-tetramethyl-7-oxa-3,20-diaza-21-oxo-dispiro[5·1·9·19] heneicon, bis-(2,2,6,6-tetramethyl-4-piperidinyl) sebacate, dimethyl succinate, 2-(4-hydroxy-2,2,6,6-tetramethyl-1-piperidinyl) ethynol condensate, and [(6-(1,1,3,3-tetramethylbutyl)imino)-1,3,5-triazin-2,4-diyl-(4-(2,2,6,6-tetramethylpiperidinyl)imino)-hexamethylene-(2,2,6,6-tetramethylpiperidinyl)imino)]. These can be used singly or in mixtures of two or more types.

Preservatives, bactericides, leveling agents, and other such additives can also be added to the above-mentioned overcoat liquid.

The above-mentioned overcoat liquid used in the present invention can be prepared by dissolving or dispersing the essential active components listed above, or the above-mentioned active components [sic], in the above-mentioned solvent by a standard method, with no particular restrictions thereon. Since the overcoat liquid is discharged from an ink jet head, it should have the same properties as the ink, such as its surface tension, viscosity, and pH.

The present invention provides the recording device defined above, comprising the container for holding ink, the container for holding a treatment agent, a detector for detecting the type of substrate of the recording medium, a pre-print controller for controlling the discharge conditions for the treatment agent used to form the ink receiving layer on the basis of the information detected by the detector, and a pre-print head for discharging the treatment agent used to form an ink receiving layer when driven on the basis of the control information of the preprint controller.

The present invention provides the recording device defined above, further comprising the container for holding an overcoat liquid, a post-print controller for controlling the discharge conditions for the overcoat liquid on the basis of the information from the detector, and a post-print head for discharging the overcoat liquid when driven on the basis of the control information of the post-print controller.

The present invention provides the recording device defined above, further comprising a drying component for drying the recording surface of the substrate of the recording medium onto which the treatment agent for forming an ink receiving layer has been discharged.

The present invention provides a recording device, comprising a print head for discharging ink, and an ink receiving layer coating apparatus for forming an ink receiving layer on the substrate surface of a recording medium prior to recording with the ink discharged from the print head.

The above-mentioned recording device may comprise an overcoat liquid coating apparatus for coating the recording surface with an overcoat liquid, on which recording is performed.

The above-mentioned recording device may comprise a container for holding a treatment agent, which holds a treatment agent for forming the ink receiving layer and is detachably mounted to a main body.

The above-mentioned recording device may comprise a container for holding an overcoat liquid, which holds the overcoat liquid and is detachably mounted to a main body.

In the above-mentioned recording device, the treatment agent that forms the ink receiving layer may contain a pigment and a binder.

In the above-mentioned recording device, the drying apparatus may be disposed near the ink receiving layer coating apparatus.

In the above-mentioned recording device, the ink receiving layer coating apparatus, the drying apparatus, the print head, and the overcoat liquid coating apparatus may be formed in that order from the downstream side in the direction in which the recording medium is conveyed.

The present invention provides a recording method in which recording is performed on the substrate of a recording medium by discharging ink by ink jet method, comprising the steps of forming an ink receiving layer on the substrate of the recording medium, drying the ink receiving layer thus formed, discharging ink to form an image, and using an overcoat liquid to perform an overcoat treatment.

The present invention provides recorded matter which has been recorded using the above-mentioned recording method.

Figure 1:
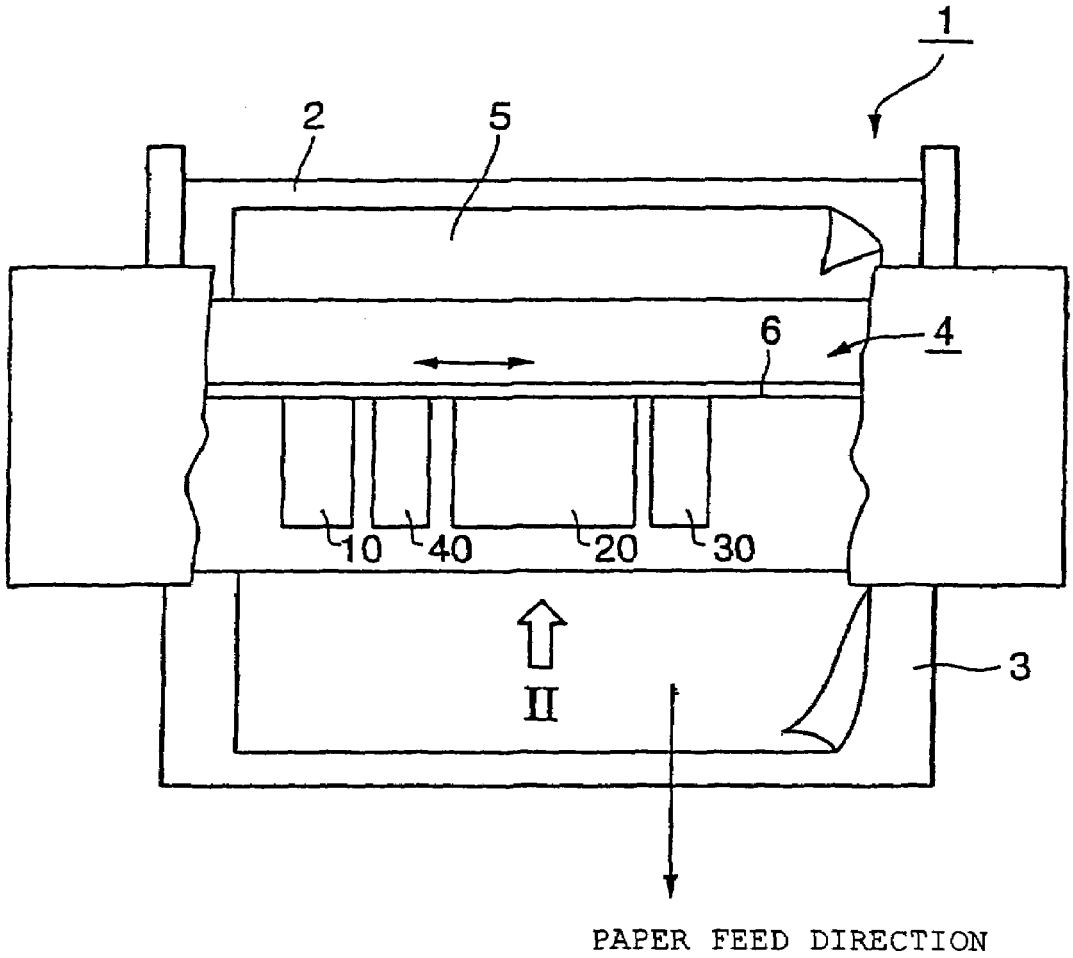
FIG. 1 is a plan view schematically illustrating the interior of a recording device pertaining to the first embodiment of the present invention as viewed from above.

In the drawings, 1 is a recording device, 2 is a paper feed component, 3 is a paper output component, 4 is a printing component, 5 is a substrate of a recording medium, 6 is a carriage, 10 is a treatment agent cartridge for forming an ink receiving layer, 11 is a pre-print head, 20 is an ink cartridge, 21 is a print head, 30 is an overcoat liquid cartridge, 31 is a post-print head, and 40 is a drying component.

BEST MODE FOR CARRYING OUT THE INVENTION

Preferred embodiments of the present invention will now be described in detail through reference to the drawings, but the present invention is not limited to or by these embodiments.

First Embodiment

Figure 2:
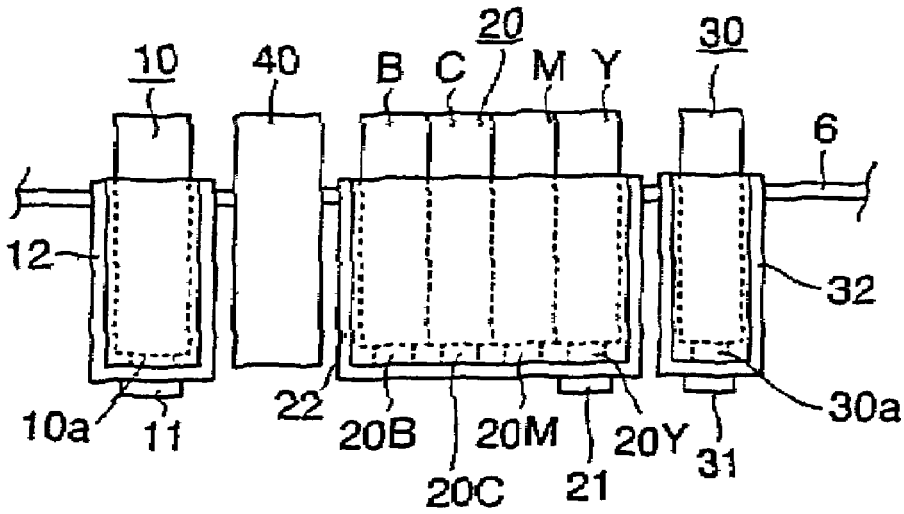
FIG. 2 is a view in the direction of the arrow II in FIG. 1.

FIG. 1 is a plan view schematically illustrating how the interior of a recording device pertaining to the first embodiment of the present invention looks when viewed from above, and FIG. 2 is a view in the direction of the arrow II in FIG. 1.

As shown in FIG. 1, the recording device in this embodiment is an ink jet recording device equipped with an ink cartridge (container for holding ink) 20 and a treatment agent cartridge (container for holding a treatment agent) 10 used to form an ink receiving layer, and allows an ink receiving layer to be formed on the substrate of a recording medium.

The recording device 1 in this embodiment will now be described in specific terms. As shown in FIG. 1, the recording device 1 in this embodiment is the same as an ordinary ink jet recording device in that a paper feed component 2 is located at the rear of the recording device, a paper output component 3 for outputting the printed recording medium substrate 5 is located at the front of the recording device, and a printing component 4 is provided within the main part of the recording device.

In this embodiment, as shown in FIGS. 1 and 2, the printing component 4 is provided with the treatment agent cartridge 10 for forming an ink receiving layer, the ink cartridge 20, and an overcoat liquid cartridge 30. The ink cartridge is attached to the carriage 6, and is enabled to move in the direction of the arrow in FIG. 1 by a timing belt (not shown) that moves the carriage 6, and a motor (not shown) that drives the timing belt.

The cartridges 10, 20, and 30 are removably enclosed in housings 12, 22, and 32, respectively, which are fixed to the carriage 6. The pre-print head 11, the print head 21, and the post-print head 31 are provided to the bottom surfaces of the housings 12, 22, and 32, respectively. The various print heads can be structured the same as the print heads in conventional recording devices. The coating apparatus of the pre-print head 11, the post-print head 31, etc., can be in the form of a roller, a sprayer, or the like.

When a head is used that selectively discharges a treatment agent or other liquid from a plurality of nozzles formed in the head just as with the head that discharges ink, the coating amount on the recording medium can be controlled accurately and easily.

The treatment agent cartridge 10 for forming an ink receiving layer is in the form of a hollow, rectangular box, and the pre-print head 11 is provided with a supply port 10*a* for supplying the treatment agent used to form an ink receiving layer.

The ink cartridge 20 consists of four ink chambers Y, M, C, and B, containing yellow, magenta, cyan, and black ink, respectively, which are disposed in series. These ink chambers are provided with ink supply ports 20Y, 20M, 20C, and 20B, respectively, for supplying ink to the print head 21, which serves as the ink discharge port from the ink chambers.

The overcoat liquid cartridge 30 is in the form of a hollow, rectangular box, and the post-print head 31 is provided with a supply port 30*a* for supplying the overcoat liquid.

The treatment agent cartridge and the overcoat liquid cartridge may each contain a porous material for holding the various liquids in the hollow box.

In addition to a configuration in which the cartridges ride on the carriage, they may, for example, be removably fixed to the main part of the device and are connected by tubes or the like to the various heads riding on the carriage, allowing the liquids to be supplied. In this case, the volume can be increased over that when the cartridges ride on the carriage.

The recording device 1 is also equipped with a drying component 40 for drying the recording surface of the recording medium substrate on which the ink has been discharged.

In this embodiment, the drying component 40 is structured so as to be able to blow hot air, and more specifically can be structured the same as an ordinary dryer.

With the recording device in this embodiment, the recording medium substrate 5 is set in the paper feed component 2, and a recording start signal is sent from a personal computer or other specific control means (not shown). The recording medium substrate 5 is moved to a location facing the print heads 11, 21, and 31. The treatment agent used to form an ink receiving layer is then discharged from the pre-print head 11 on the basis of the information sent from the control means, and hot air is blown from the drying component 40 to dry [this treatment agent] and form an ink receiving layer. After the ink receiving layer is formed, ink is discharged from the print head 21 to form the desired image. The overcoat liquid is then discharged from the post-print head 31 to form an overcoat layer on the recording surface.

The discharge of the treatment agent used to form an ink receiving layer here may be performed over the entire recording medium substrate, or the ink receiving layer may be formed over just the portion where [ink] is discharged from the print head 21. Similarly, the discharge of the overcoat liquid may be performed over the entire recording medium substrate, or [the overcoat liquid] may be selectively discharged only over the portion where the ink is discharged from the print head 21.

In this case, it is preferable for the ink receiving layer to be formed larger than the region where the image is to be formed, and if the overcoat liquid [region] is formed larger than the region where the ink receiving layer is formed, then recorded matter in which the various layers fulfill their functions can be obtained even if there is a certain amount of positional shifting or the like.

The amount in which the recording medium is coated with the treatment agent used to form an ink receiving layer will vary with the solids concentration in the treatment agent being used, but is preferably 0.5 to 50 g/m$^2$, and even more preferably 1.0 to 25 g/m$^2$, as solids.

The amount in which the recording medium is coated with the overcoat liquid will vary with the solids concentration in the overcoat liquid, but is preferably 0.5 to 50 g/m$^2$, and even more preferably 1.0 to 25 g/m$^2$, as solids.

The treatment performed by the drying component 40 preferably involves forced hot air, infrared rays, or the like, and it is preferable for the drying component 40 to be a heater.

Because the recording device in this embodiment is structured to have a treatment cartridge for forming an ink receiving layer as discussed above, high-quality recording can be performed easily, without having to select the type of recording medium. Furthermore, when there is also an overcoat liquid cartridge as in this embodiment, overcoating can also be performed, and recorded matter of high quality and with excellent storage stability can be obtained easily, even when ordinary paper is used, for example.

Second Embodiment

Figure 3:
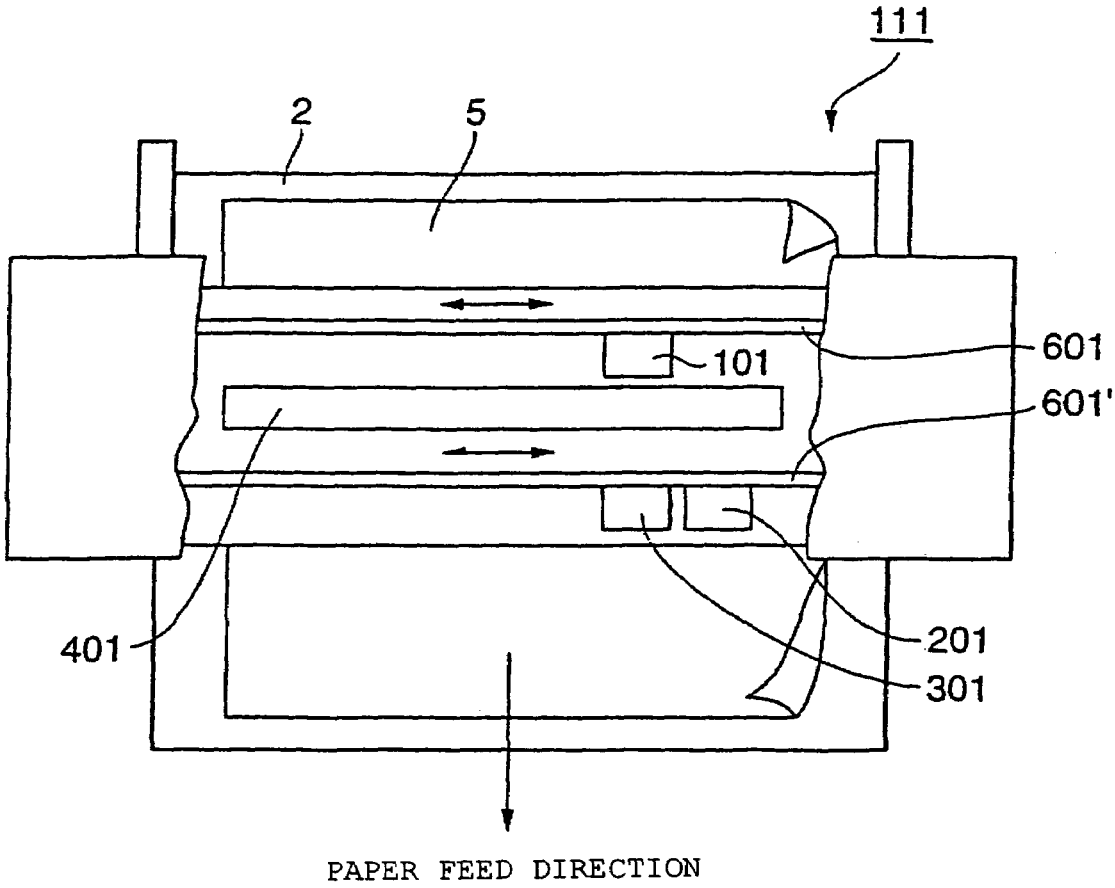
FIG. 3 is a plan view schematically illustrating how the interior of a recording device pertaining to the second embodiment of the present invention looks when viewed from above.

FIG. 3 is a plan view schematically illustrating how the interior of the recording device pertaining to the second embodiment of the present invention looks when viewed from above.

As shown in FIG. 3, the recording device 111 in this embodiment differs from the first embodiment above in that a treatment agent cartridge 101 for forming an ink receiving layer, a drying component 401, and an ink cartridge 201 and an overcoat liquid cartridge 301 are provided in that order in the paper feed direction. In FIG. 3, the treatment agent cartridge 101 for forming an ink receiving layer is attached to a carriage 601 and able to move in the direction of the arrow. The ink cartridge 201 and the overcoat liquid cartridge 301 are attached to a carriage 601' and able to move in the direction of the arrow. The drying component 401 forms a line perpendicular to the paper feed direction, and does not move.

Again in this embodiment, high-quality recording can be performed easily, without having to select the type of recording medium.

Third Embodiment

Figure 4:
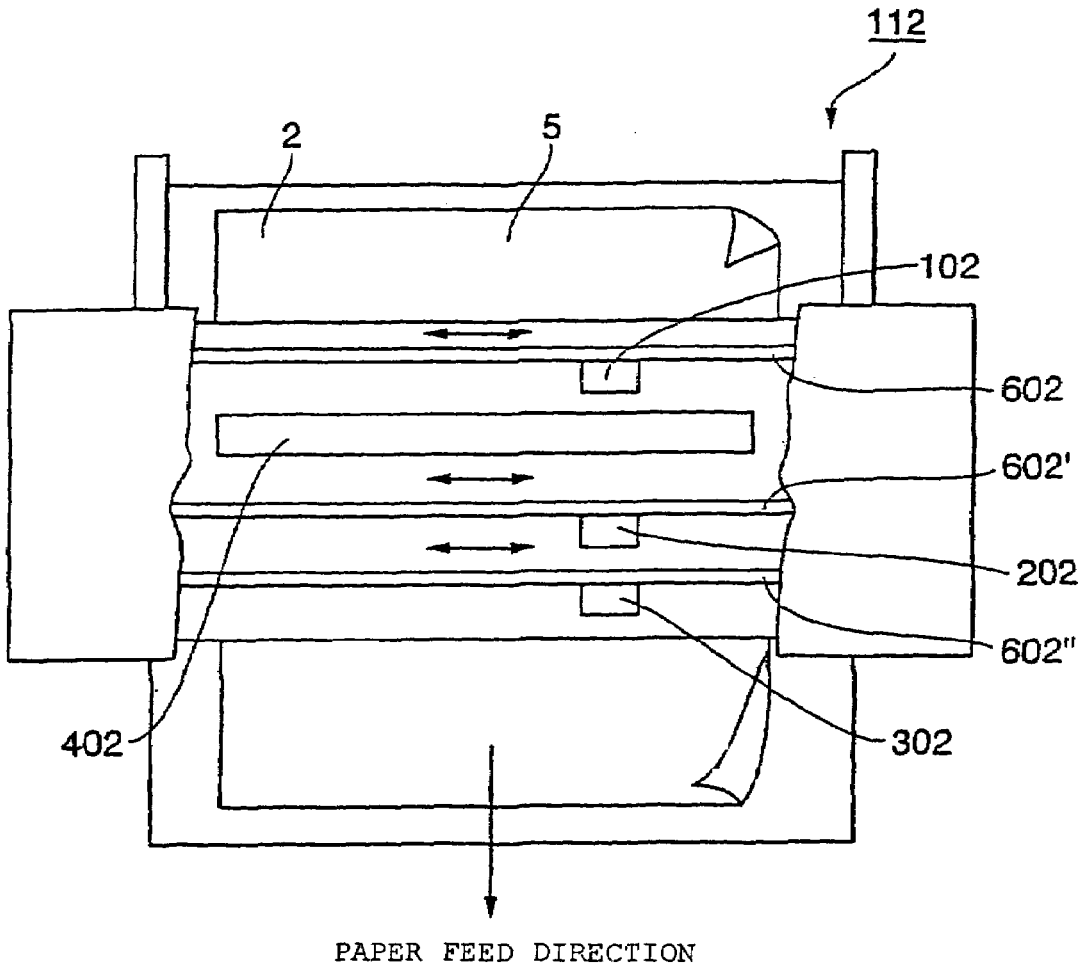
FIG. 4 is a plan view schematically illustrating how the interior of a recording device pertaining to the third embodiment of the present invention looks when viewed from above.

FIG. 4 is a plan view schematically illustrating how the interior of the recording device pertaining to the third embodiment of the present invention looks when viewed from above.

As shown in FIG. 4, the recording device 112 in this embodiment differs from the first embodiment above in that a treatment agent cartridge 102 for forming an ink receiving layer, a drying component 402, an ink cartridge 202, and an overcoat liquid cartridge 302 are provided in that order in the paper feed direction. In FIG. 4, the treatment agent cartridge 102 for forming an ink receiving layer is attached to a carriage 602 and able to move in the direction of the arrow. The ink cartridge 202 is attached to a carriage 602' and able to move in the direction of the arrow. The overcoat liquid cartridge 302 is attached to a carriage 602" and able to move in the direction of the arrow. The drying component 402 forms a line perpendicular to the paper feed direction, and does not move.

Again in this embodiment, high-quality recording can be performed easily, without having to select the type of recording medium.

Fourth Embodiment

Figure 5:
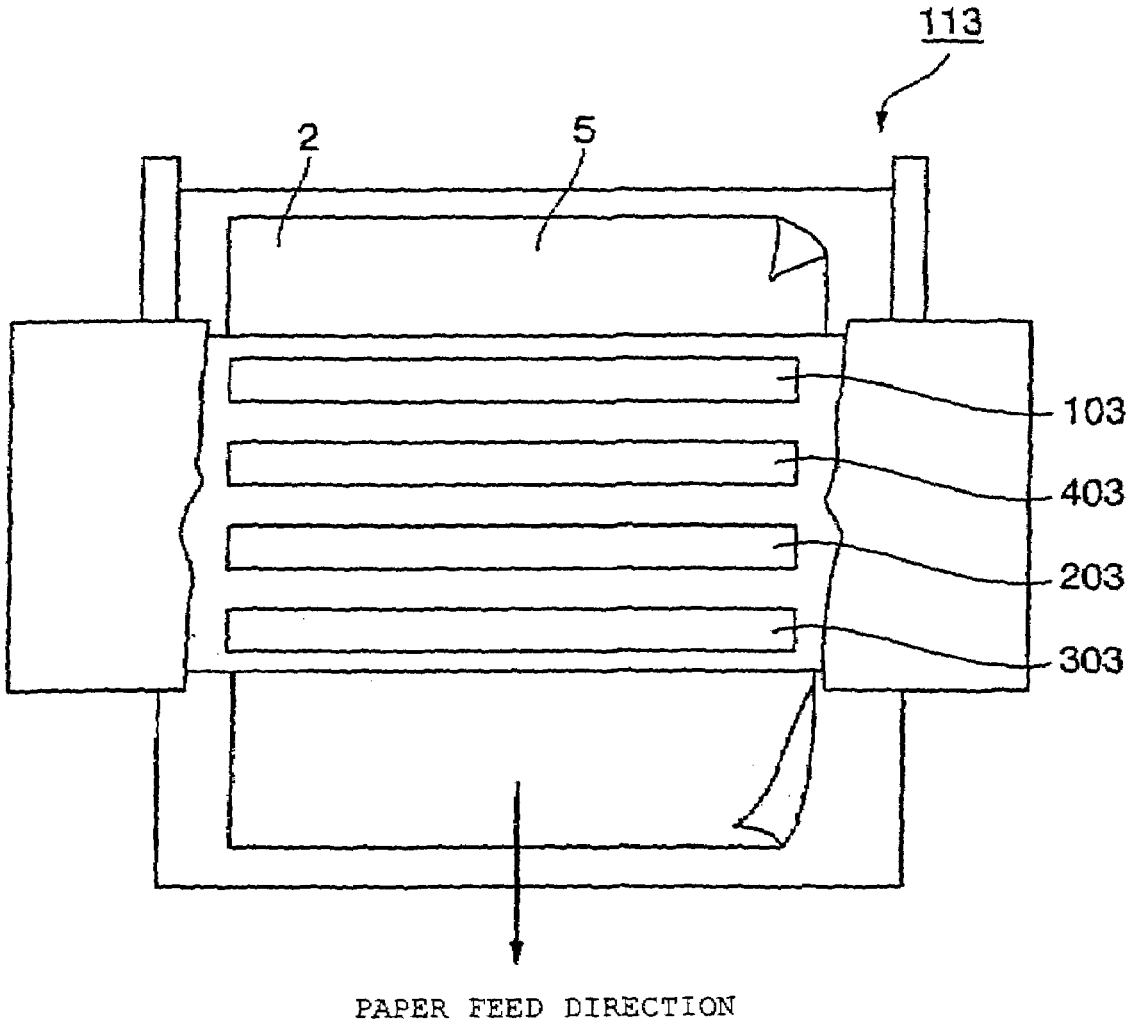
FIG. 5 is a plan view schematically illustrating how the interior of a recording device pertaining to the fourth embodiment of the present invention looks when viewed from above.

FIG. 5 is a plan view schematically illustrating how the interior of the recording device pertaining to the fourth embodiment of the present invention looks when viewed from above.

As shown in FIG. 5, the recording device 113 in this embodiment differs from the first embodiment above in that a treatment agent cartridge 103 for forming an ink receiving layer, a drying component 403, an ink cartridge 203, and an overcoat liquid cartridge 303 are provided in that order in the paper feed direction. In FIG. 5, the treatment agent cartridge 103 for forming an ink receiving layer, the ink cartridge 203, the overcoat liquid cartridge 303, and the drying component 403 all form a line perpendicular to the paper feed direction, and do not move.

Again in this embodiment, high-quality recording can be performed easily, without having to select the type of recording medium.

Fifth Embodiment

Figure 6:
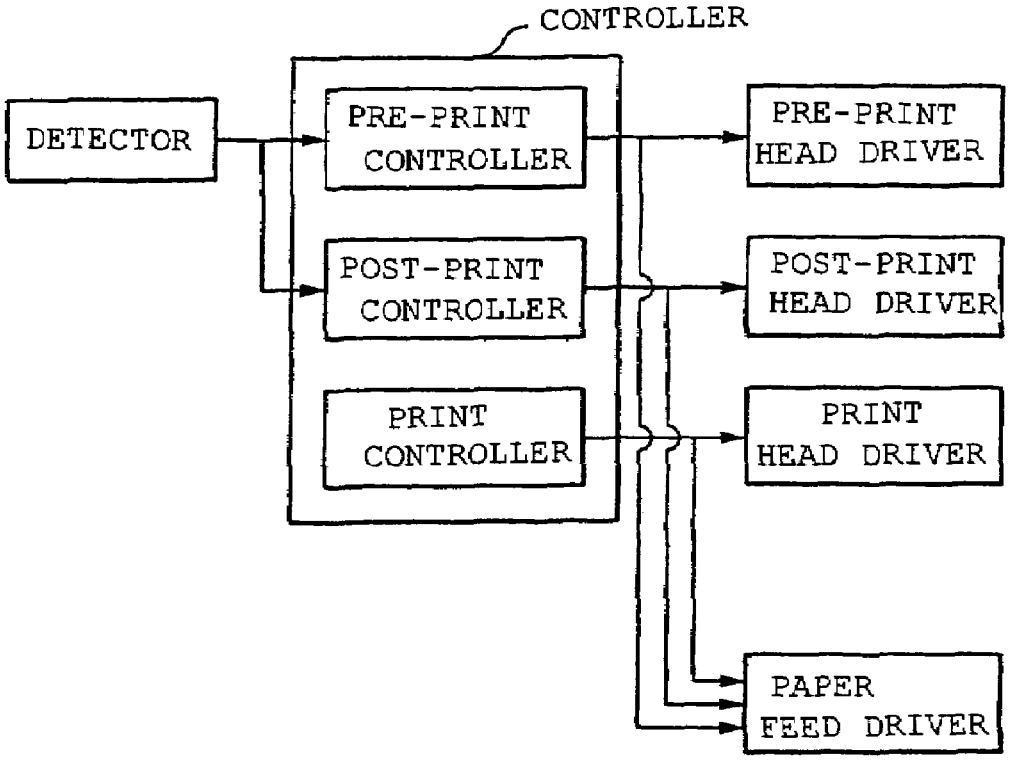
FIG. 6 is a function block diagram illustrating the printing system in the recording device of the present invention.

FIG. 6 is a function block diagram illustrating the printing system in the recording device pertaining to a fifth embodiment of the present invention.

The recording device of the present invention comprises a detector for detecting the type of substrate of the recording medium, a pre-print controller for controlling the discharge conditions for the treatment agent used to form the ink receiving layer on the basis of the information detected by the detector, a pre-print head for discharging the treatment agent used to form an ink receiving layer when driven on the basis of the control information of the preprint controller, a post-print controller for controlling the discharge conditions for the overcoat liquid on the basis of the information from the detector, and a post-print head for discharging the overcoat liquid when driven on the basis of the control information of the post-print controller. As shown in FIG. 6, the pre-print controller determines the discharge conditions for the treatment agent used to form an ink receiving layer on the basis of information obtained by the detector, and outputs signals to a pre-print head driver, which drives the pre-print head, and to a paper feed driver. The post-print controller determines the discharge conditions for the overcoat liquid on the basis of information obtained by the detector, and outputs signals to a post-print head driver, which drives the post-print head, and to the paper feed driver. The print controller outputs signals to the print head and the paper feed driver by a standard method.

In this embodiment, a detector that identifies the type of recording medium is provided, allowing the optimal treatment agent used to form an ink receiving layer to be applied according to the type of substrate of the recording medium on the basis of the information provided by the detector. Furthermore, the optimal overcoat liquid can be applied according to the type of substrate of the recording medium on the basis of the information provided by the detector.

The detector used here may, for example, consist of photodetection means for identifying reflected light on the basis of the difference in optical reflectance between glossy paper and matte paper, barcode reading means for reading a barcode printed ahead of time on the substrate of the recording medium, an IC reader, or the like.

The present invention is not limited in any way by the embodiments given above, and various modifications are possible within the scope of the essence of the present invention.

The above description was for a case in which the treatment agent cartridge for forming an ink receiving layer, the ink cartridge, and the overcoat liquid cartridge were all separate from one another, but an ink cartridge with an integrated structure may also be used, in which chambers for holding the various inks, a chamber for holding the treatment agent used to form an ink receiving layer, and/or a chamber for holding the overcoat liquid are provided inside an integrated cartridge.

INDUSTRIAL APPLICABILITY

With the present invention, the treatment agent used to form an ink receiving layer, container for holding ink, and recording device and recording method in which these [containers] are used allow high-quality recording to be performed easily, without having to select the type of recording medium.

The invention claimed is:

1. An ink-jet recording device, comprising:

(a) detector means for detecting a type of a recording medium by identifying information pertaining to an optical reflectance of a substrate of the recording medium that provides a basis for choosing an optimal treatment agent for forming an ink receiving layer on the recording medium;

(b) a pre-print controller for choosing an optimal treatment agent for forming an ink receiving layer on the recording medium on the basis of the information provided by the detector means as to the substrate;

(c) a pre-print head for discharging onto the recording medium the optimal treatment agent chosen by the pre-print controller;

(d) an ink jet head for discharging an ink onto the recording medium atop the optimal treatment agent;

(e) a post-print controller for choosing an optimal overcoat liquid on the basis of information provided by the detector means as to the type of the recording medium; and (f) a post-print head for discharging onto the recording medium atop the ink the optimal overcoat liquid chosen by the post-print controller.

2. The ink-jet recording device according to claim 1, wherein the device comprises a treatment agent containing a pigment, a binder and an auxiliary component.

3. The ink-jet recording device according to claim 1, wherein the device comprises an overcoat liquid comprising components that provide the overcoat liquid with a function selected from the group consisting of improving gloss, providing a matte finish, improving water resistance, preventing oxidation, absorbing UV rays, absorbing radicals and improving film formability.

4. A method for ink-jet printing comprising the steps of:

(a) detecting a type of recording medium by identifying information pertaining to an optical reflectance of a substrate of the recording medium that provides a basis for choosing an optimal treatment agent for forming an ink receiving layer on the recording medium;

(b) choosing an optimal treatment agent for applying to the recording medium on the basis of information as to the type of recording medium detected in step (a), and discharging the optimal treatment agent from a pre-print head of an ink-jet printer onto the recording medium to form an ink receiving layer;

(c) discharging an ink from an ink-jet head of the ink-jet printer onto the ink receiving layer;

(d) choosing an optimal overcoat liquid for applying to the recording medium on the basis of the information as to the type of recording medium detected in step (a), and discharging the optimal overcoat liquid from a post-print head of the ink-jet printer onto the recording medium atop the ink discharged in step (c).

5. The method according to claim 4, wherein the optimal treatment agent discharged in step (b) comprises a pigment, a binder and an auxiliary component.

6. The method according to claim 4, wherein the optimal overcoat liquid discharged in step (d) comprises components that provide the overcoat layer with a function selected from the group consisting of improving gloss, providing a matte finish, improving water resistance, preventing oxidation, absorbing UV rays, absorbing radicals and improving film formability.

* * * * *